US010019969B2

(12) United States Patent
Edwall et al.

(10) Patent No.: US 10,019,969 B2
(45) Date of Patent: Jul. 10, 2018

(54) PRESENTING DIGITAL IMAGES WITH RENDER-TILES

(71) Applicant: Apple Inc., Cupertino, CA (US)

(72) Inventors: Charles Edwall, Sunnyvale, CA (US); Alexis Allison Iskander, San Jose, CA (US)

(73) Assignee: Apple Inc., Cupertino, CA (US)

( * ) Notice: Subject to any disclaimer, the term of this patent is extended or adjusted under 35 U.S.C. 154(b) by 69 days.

(21) Appl. No.: 14/329,764

(22) Filed: Jul. 11, 2014

(65) Prior Publication Data

US 2015/0262556 A1 Sep. 17, 2015

Related U.S. Application Data

(60) Provisional application No. 61/953,581, filed on Mar. 14, 2014.

(51) Int. Cl.
*G09G 5/393* (2006.01)
*G09G 5/14* (2006.01)

(52) U.S. Cl.
CPC ..... *G09G 5/393* (2013.01); *G09G 5/14* (2013.01); *G09G 2330/022* (2013.01)

(58) Field of Classification Search
CPC .... G09G 2330/022; G09G 5/14; G09G 5/393; G09G 5/391; G06T 11/40; G06T 3/005; G06T 2200/32; G06T 2210/36; G06T 11/60; G01C 21/34; G02B 21/0016; G02B 21/26; G06F 3/122
USPC ..... 345/545
See application file for complete search history.

(56) References Cited

U.S. PATENT DOCUMENTS

| | | | | |
|---|---|---|---|---|
| 8,571,338 | B2 | 10/2013 | Inada et al. | |
| 2012/0182445 | A1 | 7/2012 | You et al. | |
| 2013/0063443 | A1 | 3/2013 | Garside et al. | |
| 2013/0328896 | A1* | 12/2013 | Belanger | G06T 1/60 345/531 |
| 2014/0063058 | A1 | 3/2014 | Fialho et al. | |
| 2014/0375663 | A1* | 12/2014 | Pfaffe | G06T 1/60 345/545 |
| 2015/0091892 | A1* | 4/2015 | Kwon | G06T 15/005 345/419 |

FOREIGN PATENT DOCUMENTS

| | | |
|---|---|---|
| WO | 2008/147561 | 12/2008 |

* cited by examiner

*Primary Examiner* — Gregory J Tryder
*Assistant Examiner* — Kwang Lee
(74) *Attorney, Agent, or Firm* — Womble Bond Dickinson (US) LLP

(57) ABSTRACT

An image can be presented using render-tiles, which are movable rendering contexts in which multiple image-tiles can be drawn as a single image. To optimize performance, the render-tiles can be large enough to minimize the number of render-tiles necessary to present the image within the screen view of a client device, while remaining small enough to avoid memory or performance issues when panning or zooming the image. A set of active image-tiles and active render-tiles can be identified based on a specified view boundary that represents a portion of the image that is presented by a client device. The active render-tiles can be presented by the client device and the image-tiles can be drawn into the render-tiles to present the image. The render-tiles can be generated as needed and inactive render-tiles can be stored for later use or recycled.

21 Claims, 6 Drawing Sheets

FIG. 2

200

205

| | | | | | |
|---|---|---|---|---|---|
| 0,0 | 0,1 | 0,2 | 0,3 | 0,4 | 0,5 |
| 1,0 | 1,1 | 1,2 | 1,3 | 1,4 | 1,5 |
| 2,0 | 2,1 | 2,2 | 2,3 | 2,4 | 2,5 |
| 3,0 | 3,1 | 3,2 | 3,3 | 3,4 | 3,5 |
| 4,0 | 4,1 | 4,2 | 4,3 | 4,4 | 4,5 |
| 5,0 | 5,1 | 5,2 | 5,3 | 5,4 | 5,5 |

PRESENTING DIGITAL IMAGES WITH RENDER-TILES

CROSS REFERENCE TO RELATED APPLICATIONS

This application claims priority to U.S. provisional application No. 61/953,581, filed on Mar. 14, 2014, which is expressly incorporated by reference herein in its entirety.

TECHNICAL FIELD

The present technology pertains to presenting digital images, and more specifically pertains to presenting digital images with render-tiles.

BACKGROUND

With the advancement of computing devices, physical content is being commonly replaced by digital content that can be presented on a computing device. For example, large images, such as maps, are commonly viewed as digital images on computing devices. While the size of a digital image presented by a computing device can be essentially limitless, the view available to the user is limited by the size and resolution of the monitor or screen used by the computing device. As a result, computing devices commonly present only a portion of the overall image and enable a user to pan and zoom the image to view other portions of the image that are not currently displayed.

While viewing images in this manner is convenient, managing large digital images provides technological challenges. For example, rendering an extremely large image as a single image can exceed the computing limitations of the computing device. Alternatively, presenting a large image as a collection of smaller images can be difficult to manage when the image is panned or zoomed. Accordingly, improvements are needed.

SUMMARY

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

Disclosed are systems, methods, and non-transitory computer-readable storage media for presenting digital images with render-tiles. A render-tile can be a movable rendering context in which multiple image-tiles can be drawn as a single image. For example, multiple image-tiles can be drawn within a render-tile in the appropriate adjacent positions relative to one another so as to appear as a single continuous portion of the image, which may entirely fill the render-tile. To optimize performance, the render-tiles can be large enough to minimize the number of render-tiles necessary to present the image within the screen view of a client device, while remaining small enough to avoid memory or performance issues when panning or zooming the image.

An image can be divided into a set of image-tiles forming an image-tile map, where each image-tile in the image-tile map portrays a distinct portion of the image. To present the image using render-tiles, a set of active image-tiles that intersect with or are within a specified view boundary can be identified. The specified view boundary can indicate a portion of the image that is being presented within a screen view of a client device rendering the image.

The active image-tiles can be rendered by a set of render-tiles that can each be a movable rendering context in which multiple image-tiles can be drawn as a single image. Each image can be designated a set of render-tiles that form a render-tile map, where each render-tile in the render-tile map is designated to render a distinct portion of the image. A set of active render-tiles can be identified that intersect with or fall within the specified view boundary.

The active-render tiles can be presented on the display of a client device. This can include presenting the render-tiles in the appropriate positions to properly present the portion of the image defined by the specified view boundary. The active image-tiles can be drawn into the presented render-tiles to present the image.

In some embodiments, render-tiles can be managed to minimize resource usage. For example, render-tiles can be rendered as needed, i.e. as they become active render-tiles. For example, a render tile can become active due to a change in the specified view boundary that causes a render tile that was not active to intersect with or fall within the specified view boundary. Further, generated render-tiles that become inactive, i.e., do not intersect with or fall within the specified view boundary, can be stored in memory for later use. For example, an inactive render-tile may again become active, at which point the render-tile can be accessed from memory rather than being regenerated. Alternatively, the inactive render-tile can be recycled. For example, the inactive render-tile can be reassigned as a newly activated render-tile, rather than generating a new render-tile.

BRIEF DESCRIPTION OF THE DRAWINGS

The above-recited and other advantages and features of the disclosure will become apparent by reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which:

FIG. 2 shows an exemplary embodiment of an image-tile map;

DESCRIPTION

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

The disclosed technology addresses the need in the art for presenting digital images with render-tiles. A render-tile can be a movable rendering context in which multiple image-tiles can be drawn as a single image. To optimize performance, the render-tiles can be large enough to minimize the number of render-tiles necessary to present the image within the screen view of a client device, while remaining small enough to avoid memory or performance issues when panning or zooming the image.

An image can be divided into a set of image-tiles forming an image-tile map, where each image-tile in the image-tile map portrays a distinct portion of the image. To present the image using render-tiles, a set of active image-tiles that intersect with or are within a specified view boundary can be identified. The specified view boundary can indicate a portion of the image that is being presented within a screen view of a client device rendering the image.

The active image-tiles can be rendered by a set of render-tiles that can each be a movable rendering context in which multiple image-tiles can be drawn as a single image. Each image can be designated a set of render-tiles that form a render-tile map, where each render-tile in the render-tile map is designated to render a distinct portion of the image. A set of active render-tiles can be identified that intersect with or fall within the specified view boundary.

The active-render tiles can be presented on the display of a client device. This can include presenting the render-tiles in the appropriate positions to properly present the portion of the image defined by the specified view boundary. The active image-tiles can be drawn into the presented render-tiles to present the image.

In some embodiments, render-tiles can be managed to minimize resource usage. For example, render-tiles can be rendered as needed, i.e. as they become active render-tiles. For example, a render tile can become active due to a change in the specified view boundary that causes a render tile that was not active to intersect with or fall within the specified view boundary. Further, generated render-tiles that become inactive, i.e., do not intersect with or fall within the specified view boundary, can be stored in memory for later use. For example, an inactive render-tile may again become active, at which point the render-tile can be accessed from memory rather than being regenerated. Alternatively, the inactive render-tile can be recycled. For example, the inactive render-tile can be reassigned as a newly activated render-tile, rather than generating a new render-tile.

Figure 1:
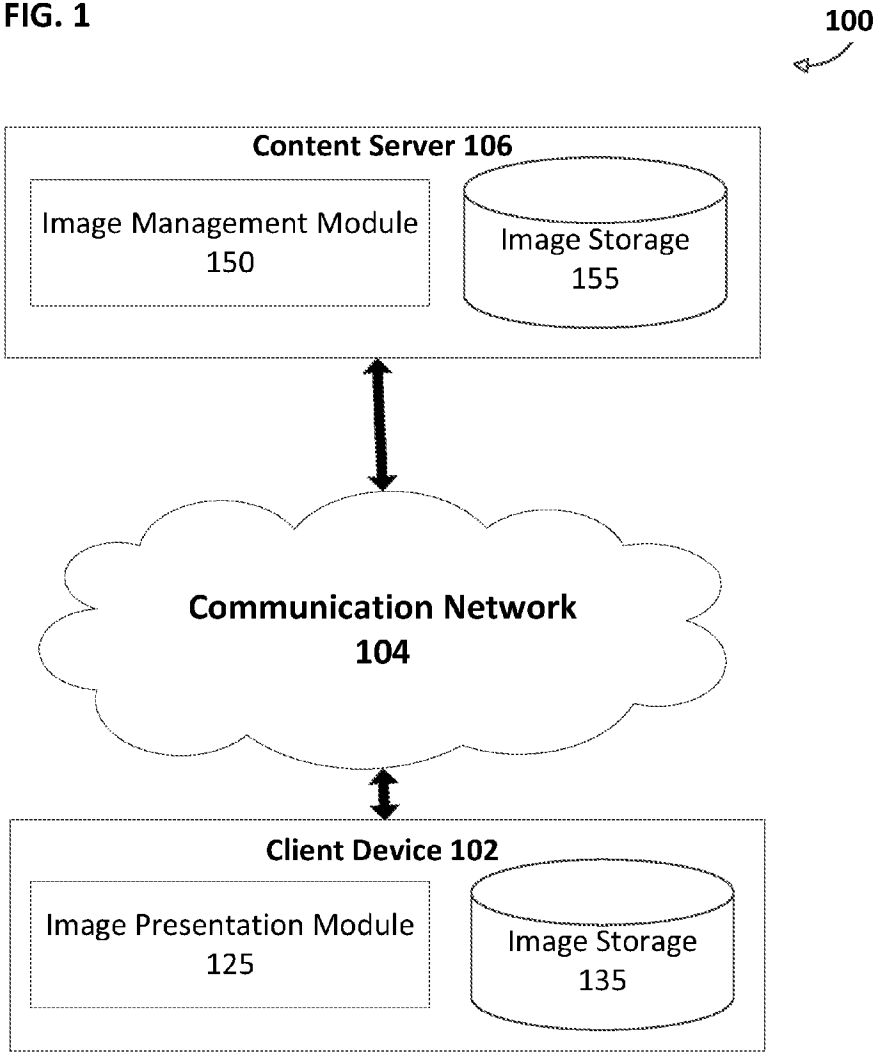
FIG. 1 shows an exemplary configuration of devices and a network in accordance with the invention.

FIG. 1 illustrates an exemplary system configuration 100, wherein electronic devices communicate via a network for purposes of exchanging content and other data. As illustrated, multiple computing devices can be connected to communication network 104 and be configured to communicate with each other through use of communication network 104.

Communication network 104 can be any type of network, including a local area network ("LAN"), such as an intranet, a wide area network ("WAN"), such as the internet, or any combination thereof. Further, communication network 104 can be a public network, a private network, or a combination thereof. Communication network 104 can also be implemented using any number of communications links associated with one or more service providers, including one or more wired communication links, one or more wireless communication links, or any combination thereof. Additionally, communication network 104 can be configured to support the transmission of data formatted using any number of protocols.

Multiple computing devices can be connected to communication network 104. A computing device can be any type of general computing device capable of network communication with other computing devices. For example, a computing device can be a personal computing device such as a desktop or workstation, a business server, or a portable computing device, such as a laptop, smart phone, or a tablet PC. A computing device can include some or all of the features, components, and peripherals of computing device 600 of FIGS. 6A and 6B.

To facilitate communication with other computing devices, a computing device can also include a communication interface configured to receive a communication, such as a request, data, etc., from another computing device in network communication with the computing device and pass the communication along to an appropriate module running on the computing device. The communication interface can also be configured to send a communication to another computing device in network communication with the computing device.

As illustrated, system 100 includes content server 106 and client device 102 connected to communication network 104 to communicate with each other to transmit and receive data. In system 100, image data representing an image can be delivered to client device 102 connected to communication network 104 by direct and/or indirect communications with content server 106. In particular, content server 106 can receive a request from client device 102 for image data representing an image, such as a map, managed by content server 106.

Content server 106 can include image management module 150 configured to receive an image request from client device 102 for a specified image. Image data can be stored in image storage 155 and image management module 150 can be configured to communicate with image storage 155 to gather the requested image data and transmit the requested image data to client device 102.

Client device 102 can be configured to transmit an image request to content server 106 and render the image data received from content server 106 in response to the image request. Rendering the image data can include displaying the image data appropriately to present the digital image on a screen of client device 102. For example, client device 102 can include image presentation module 125 capable of processing the received image data and rendering the digital image. In some embodiments, image presentation module 125 can be a web-browser application. Alternatively, in some embodiments, image presentation application 125 can be a client-side application.

Image presentation module 125 can be configured to enable a user to interact with the rendered digital image. This can include moving or panning a rendered image, changing the zoom level of the rendered image, etc. Image presentation module 125 can further execute any actions resulting from an interaction with the digital image, such as requesting additional image data from content server 106.

In some embodiments, the image data can define one or more image-tiles that make up at least a portion of a requested image. For example, an image can be presented as a set of image-tiles that form an image-tile map, where each individual image-tile in the image-tile map represents a distinct portion of the image. Each image-tile can be identified by an image-tile coordinate that uniquely identifies the image-tile and indicates the location of the image-tile in the image-tile map. For example, the image-tile coordinates can indicate the column and row location of the image-tile in the image-tile map. Image presentation module 125 can use the image-tile coordinates assigned to each image-tile to place the image-tiles in the appropriate position and properly render the image.

FIG. 2 shows an exemplary embodiment of an image-tile map. As shown, image 205 is broken into a 6×6 grid of image-tiles. Each image-tile is assigned an image-tile coordinate that identifies the specified image-tile and indicates the location of the image-tile in image-tile map 200. For example, the image-tile coordinate assigned to an image-tile can represent the row and column of the image-tile in image-tile map 200. As shown, the image-tiles in image-tile map 200 are assigned coordinates from (0,0) to (5,5) indicating the row and column of each image-tile. The assigned coordinates can be used to locate the location of each image-tile to properly render image 205.

Returning to the discussion of FIG. 1, image presentation module 125 can be configured to request a specified subset of image-tiles from content server 106. For example, image presentation module 125 can request a set of image-tiles based on a specified view boundary of the image. The specified view boundary can define a portion of the image and image presentation module 125 can request the set the image-tiles that intersect with or fall within the specified view boundary. For example, the specified view boundary can define a portion of the image that is 'active' meaning that the portion of the image will be presented by the screen of client device 102. The set of image-tiles that intersect or fall within the specified view boundary can be considered a set of active image-tiles, meaning that at least a portion of each of the active image-tiles will be presented by client device 102. Image presentation module 125 can request the set of active image-tiles from content server 106.

In some embodiments, the specified view boundary can be based on an input received by a user of client device 102. For example, a user can enter an input indicating a point or portion of the image the user would like to view. This can include the user selecting a specified portion of the image or, alternatively, resulting from a user panning or zooming the image. Image presentation module 125 can use the received input to set the specified view boundary. For example image presentation module 125 can set the specified view boundary to center the user specified point or portion of the image within the specified view boundary, which is large enough to cover at least the screen of client device 102.

Alternatively, in some embodiments, the specified view boundary can be based on the location of client device 102. For example, when presenting an image such as a map, the specified view boundary can be based on the current location of client device 102. Image presentation module 125 can gather the location of client device 102 from a Global Positioning System (GPS) component of client device 102.

To identify the set of active image-tiles from the specified view boundary, image presentation module 125 can have access to image-tile metadata describing the image-tile map for a specified image. For example, the image-tile metadata can identify the dimensions of the requested image and the coordinates and dimensions of the image-tiles that make up the image-tile map. Client device 102 can include image storage 135 that can be configured to store image-tile metadata describing the image-tile maps for one or more images and image presentation module 125 can be configured to access image storage 135 to retrieve the image-tile metadata for a specified image.

Image presentation module 125 can use the image-tile metadata retrieved from image storage 135 to identify the set of active image-tiles that intersect with or are within the specified view boundary. Image presentation module 125 can then transmit an image request to content server 106 requesting the identified set of active image-tiles. For example, image presentation module 125 can include the image-tile coordinates of the requested set of active image-tiles in the image request transmitted to content server 106, which can be used by image management module 150 to retrieve the corresponding image data from image storage 155. Image management module 150 can then transmit the retrieved image data to client device 102.

Figure 3:
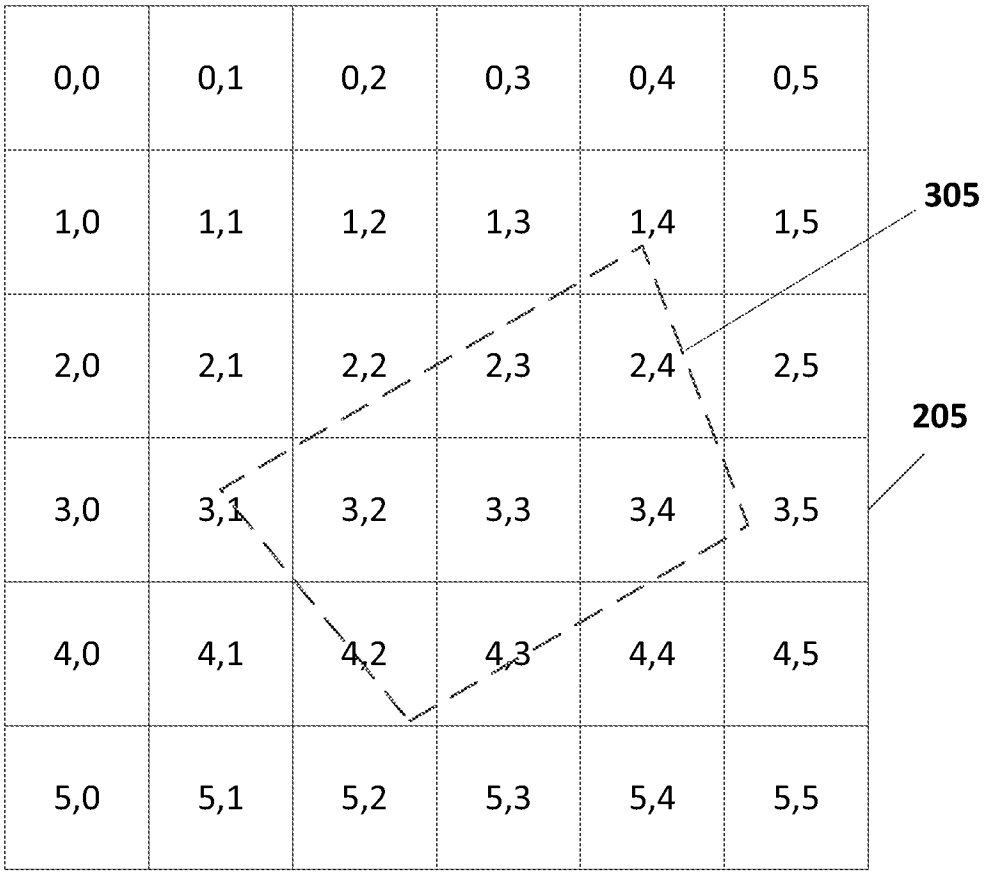
FIG. 3 shows an exemplary embodiment of a specified view boundary over an image-tile map.

FIG. 3 shows an exemplary embodiment of a specified view boundary over an image-tile map. As shown, image 205 is broken into a 6×6 grid of image-tiles. Specified view boundary 305 defines an active portion of image 205 that is to be presented by a client device. The image-tiles that intersect with or are within specified view boundary 305 can be the set of active image-tiles.

Returning to the discussion of FIG. 1, in some embodiments, client device 102 can be configured to use render-tiles to manage presentation of the image-tiles. This can include presenting the image-tiles and moving the image-tiles as a user pans or adjusts the zoom level of the rendered image. A render-tile can be a movable rendering context in which multiple image-tiles can be drawn as a single image. Using render-tiles allows client device 102 to manage presentation and movement of multiple image-tiles through a single render-tile, thus minimizing the number of objects that have to be managed by image presentation module 125.

To optimize presentation of an image, the render-tiles can be generated to be large enough to minimize the number of render-tiles necessary to present the image within the screen view of client device 102, while remaining small enough to avoid memory or performance issues when panning of zooming the rendered image. The size of the render-tiles can therefore vary depending on the computing capabilities and resources of client device 102. For example, larger render-tiles can be used when greater computing capabilities are available, whereas smaller render-tiles are used when computing capabilities are limited.

Each image can be rendered by a set of render-tiles designated to the image that form a render-tile map. Each render-tile in the render-tile map can be designated to render a distinct portion of the image. The size of each render-tile can be larger than the size of an image-tile, thus resulting in each render-tile being used to render multiple image-tiles. The larger size of the render-tiles can reduce the number of objects that image presentation module 125 needs to manage when moving the image.

Similar to image-tiles, each render-tile can be assigned a render-tile coordinate that identifies the render-tile as well as the location of the render-tile in the render-tile map. For example, the render-tile coordinate assigned to a render-tile can indicate the row and column location of the render-tile in the render-tile map.

To use render-tiles to manage presentation of the image-files, image presentation module 125 can be configured to identify a set of active render-tiles based on the specified view boundary. Image presentation module 125 can identify the set of active render-tiles from the specified view boundary, and known dimensions of the image and the dimensions of the individual render-tiles. Image presentation module 125 can use this data to identify the set of active render-tiles that intersect with or fall within the specified view boundary.

Figure 4:
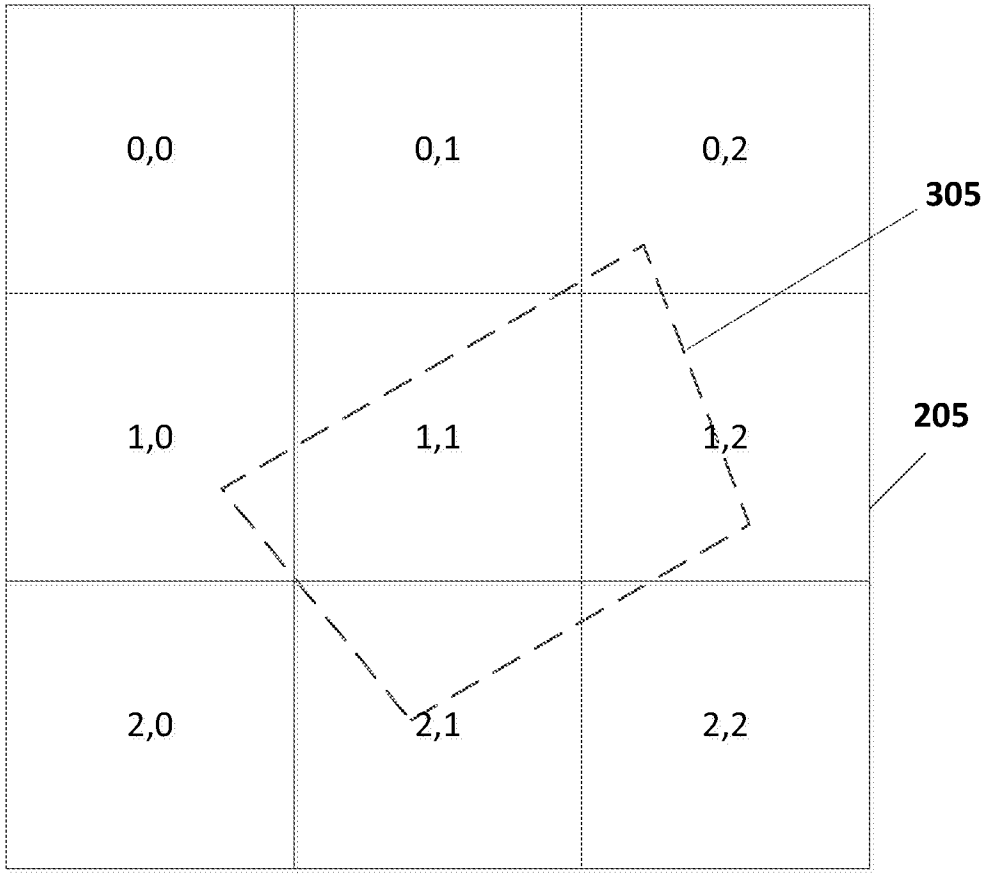
FIG. 4 shows an exemplary view of the specified view boundary over a render-tile map.

FIG. 4 shows an exemplary view of the specified view boundary over a render-tile map. As shown, image 205 is assigned a 3×3 grid of render-tiles, where each render-tile is assigned a render-tile coordinate from (0,0) to (2,2). The render-tile coordinate assigned to each render-tile can identify the render-tile as well as the location of the render-tile within render-tile map 400. For example, the render-tile coordinate for a render-tile can indicate the row and column position of the render-tile within render-tile map 400.

Specified view boundary 305 defines an active portion of image 205 that is to be presented by a client device. The render-tiles that intersect with or are within specified view boundary 305 can be the set of active render-tiles.

Returning to the discussion of FIG. 1, image presentation module 125 can be configured to present the active render-tiles within the display of client device 102. The render-tiles can be presented in the appropriate configuration as dictated by the render-tile coordinates associated with each active render-tile.

Upon presenting the active render-tiles, image presentation module 125 can then draw the active image-tiles into the render-tiles at the appropriate locations to present the image. To accomplish this, image presentation module 125 can determine the active image-tiles that intersect with each active render-tile and then draw the appropriate image-tiles into the correct location of the render-tile based on the image-tile coordinates and the known dimensions of the image-tiles and the render-tiles.

In some embodiments, an active image-tile can overlap multiple render-tiles. Image presentation module 125 can render the appropriate portion of the image-tile on each render-tile on which the image-tile overlaps.

In some embodiments, image presentation module 125 can be configured to minimize computing resources associated with generating render-tiles. For example, in some embodiments, image presentation module 125 can be configured to generate a render-tile as the render-tile becomes needed to present the image, i.e. when the render-tile becomes active. Thus, a render-tile will not be generated until the render-tile becomes active and intersects with or falls within the specified view boundary.

Further, generated render-tiles that become inactive can be maintained in memory for later use. For example, a user can pan an image causing an active-render tile to become inactive, i.e. no longer intersect with or fall within the specified view boundary. Rather than delete the inactive render-tile, image presentation module 125 can maintain the inactive render-tile in memory, although it is no longer presented by the screen of client device 102.

The inactive render-tile can be used later, if needed. For example, a user can pan an image causing an inactive render-tile to again become active. Rather than immediately generating the newly activated render-tile, image presentation module 125 can first check memory to determine whether the newly activated render-tile has already been generated and is available. If so, image presentation module 125 can access the render-tile from memory rather than re-generating the render-tile.

Alternatively, in some embodiments, image presentation module 125 can be configured to recycle inactive render-tiles stored in memory. For example, if a newly activated render-tile is not already available in memory, image presentation module 125 can be configured to recycle an inactive render-tile available in memory by reassigning the inactive render-tile as the newly activated image-tile. This can include reassigning the inactive render-tile with the render-tile coordinates of the newly activated render-tile and drawing the appropriate image-tiles onto the recycled render-tile.

Figure 5:
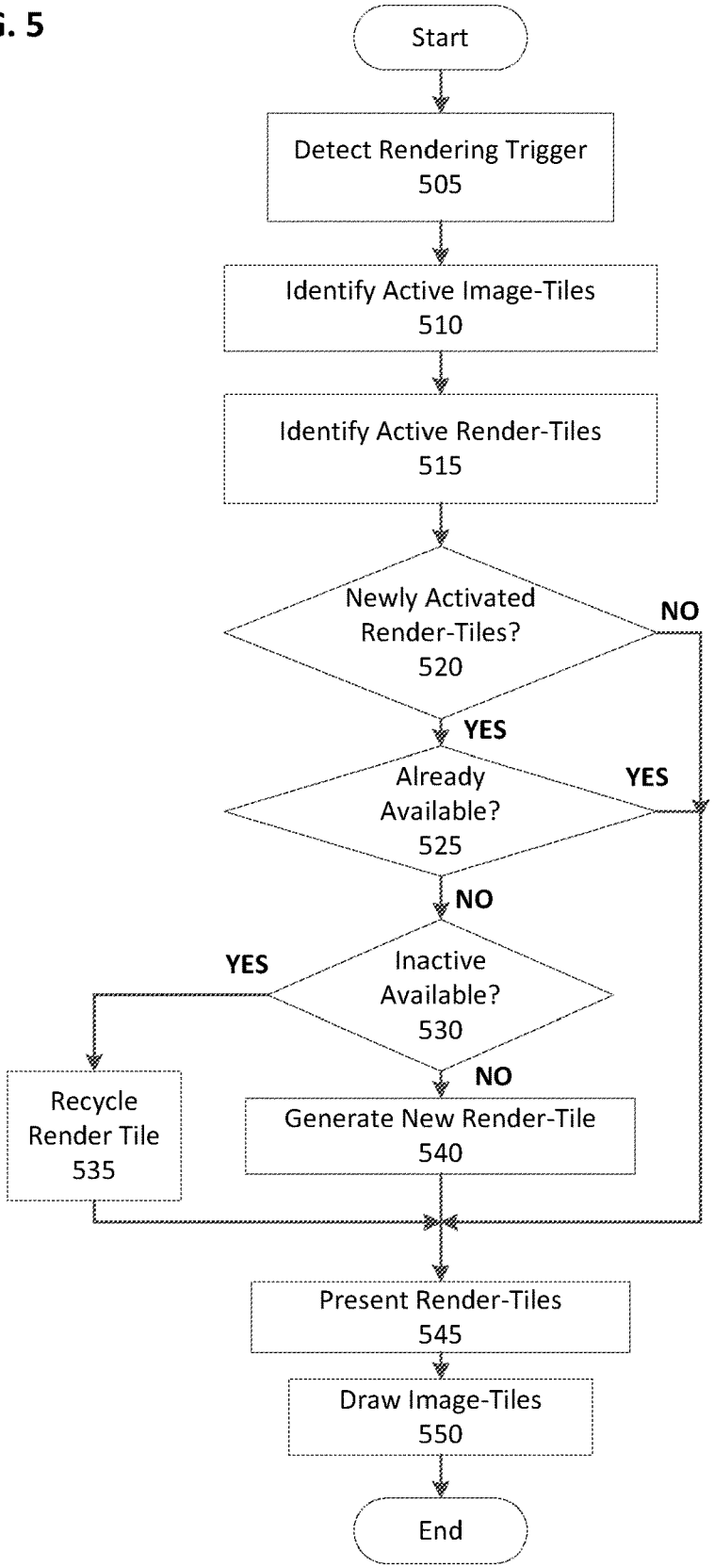
FIG. 5 illustrates an exemplary method embodiment of presenting an image using render-tiles.

FIG. 5 illustrates an exemplary method embodiment of presenting an image using render-tiles. As shown, the method begins at block 505 where a rendering trigger is detected. A rendering trigger can be an input indicating that an image needs to be rendered. For example, a rendering trigger can be a user requesting to view an image that is not currently rendered. Alternatively, a rendering trigger can be a user manipulating a currently rendered image by, for example, panning or adjusting the zoom level of the rendered image, thus requiring the image to be re-rendered.

Upon detecting a rendering trigger, the method continues to block 510 were a set of active image-tiles is identified. An image can be presented by a set of image-tiles forming an image map, where each individual image-tile in the image map portrays a distinct portion of the image. An image-tile that falls, at least partially, within a specified view boundary of the image map, can be considered an active image-tile. Conversely, image-tiles that do not fall, at least partially, within the specified view boundary can be considered inactive image-tiles.

In some embodiments, the specified view boundary can indicate a portion of the image that is being presented within a screen view of a client device that is rendering the image. Thus, the set of active image-tile would include the image-tiles that portray at least a portion of the image being presented by the client device.

In some embodiments, the specified view boundary can be set based on an input received by a user. A user can select a point or portion of the image to view and the specified view boundary can be determine based on the selected point or portion of the image. For example, when viewing an image such as a map, a user can enter a location on the map to view, such as city or country, and the specified view boundary can be based on the location specified by the user. Alternatively, a user can pan or zoom a rendered image, resulting in an updated specified view boundary.

The active image-tiles can be identified based on the specified view boundary. For example, the specified view boundary can dictate coordinates within the image map defining the specified view boundary and the set of active image-tiles can include each image-tile that intersects with or is within the specified view boundary.

Upon identifying the set of active image-tiles, the method continues to block 515 where a set of active render-tiles is identified. The image-tiles representing an image can be rendered by a set of render-tiles, which can each be a movable rendering context in which multiple image-tiles can be drawn as a single image. Each image can be designated a set of render-tiles that form a render-tile map, where each render-tile in the render-tile map is designated to render a distinct portion of the image. A render-tile can be larger than an image-tile so that multiple image-tiles can be rendered by each render-tile.

A render-tile falling at least partially within the specified image view can be an active render-tile, whereas render-tiles that do not interest or fall within the specified image view can be inactive render-tiles. The set of active render-tiles can be identified using the specified view boundary. For example, the specified view boundary can be used to identify the set of active render-tiles that intersects with or is within the specified view boundary.

In some embodiments, the relationships between the render-tiles and image-tiles can be mapped, thereby enabling the active render-tiles and/or active-image tiles to be quickly identified. For example, the image-tiles can be listed in an image-tile index that includes a separate entry for each image-tile in the image-tile map. Likewise, the render-tiles can be listed in a render-tile index that includes a separate entry for each render-tile in the render tile map. The entries in the image-tile index and the render-tile index can be mapped to indicate the render-tiles and image-tiles that intersect. For example, the entries in the image-tile index for each image-tile that is designated to a specified render-tile can be mapped to the entry in the render-tile index for the specified render-tile. Thus, the render-tiles corresponding to a group or image-tiles and vice-versa, can be identified from the existing relationships between the image-tile index and the render-tile index.

At block 520 it is determined if the set of active render-tiles includes a newly activated render-tiles. That is, the method determines whether any of the identified active render-tiles were previously inactive render-tiles that became active as a result of a change to the specified view boundary. For example, if a rendered image is panned by a user, the specified view boundary can be changed resulting in inactive render-tiles that were not within the specified view boundary to become newly activated render-tiles that are now at least partially within the specified view boundary.

If at block 520 it is determined that the set of active render-tiles includes a newly activated render-tile, the method continues to block 525 where the method determines whether the newly activated render-tile is currently available in memory. For example, to minimize resource usage, render-tiles can be generated as they are needed, i.e. as they become active render-tiles. A generated render-tile that has become inactive can be maintained in memory in the event that the render-tile again becomes active. Memory can be searched to determine whether the newly activated render-tile has already been generated and is available.

If at block 525 it is determined that the newly activated render-tile is not available in memory, the method continues to block 530 where it is determined whether an inactive render-tile is available in memory that can be recycled as the newly activated render-tile. To minimize resource usage associated with generating render-tiles, previously generated inactive render-tiles that are stored in memory can be recycled and designated as a newly activated render-tile. For example, the render-tile coordinates associated with the inactive render-tile can be reassigned to the render-tile coordinates of the newly activated render-tile. If at block 530 it is determined that there is an inactive render-tile available in memory, the method continues to block 535 where the inactive render-tile is reassigned as the newly activated render-tile. Alternatively, if at block 530 it is determined that there are no available inactive render tiles in memory, the method continues to block 540 where the newly activate render-tile is generated. It should be noted that the method described by blocks 520-540 can be performed for each newly activated render-tile in the set of active render-tiles.

The method then continues to block 545 where the active render-tiles are presented on the display of the client device. This can include presenting the render tiles in the appropriate positions of the as defined by the specified image view and the render-tile coordinates of the active render-tiles. The method then continues to block 550 where the active-image tiles are drawn into the active-render tiles. This can include drawing in newly activated image-tiles into the active render-tiles. For example, image-tiles that have already been drawn into an active render-tile do not need to be redrawn. The method can then end or repeat.

Figure 6A:
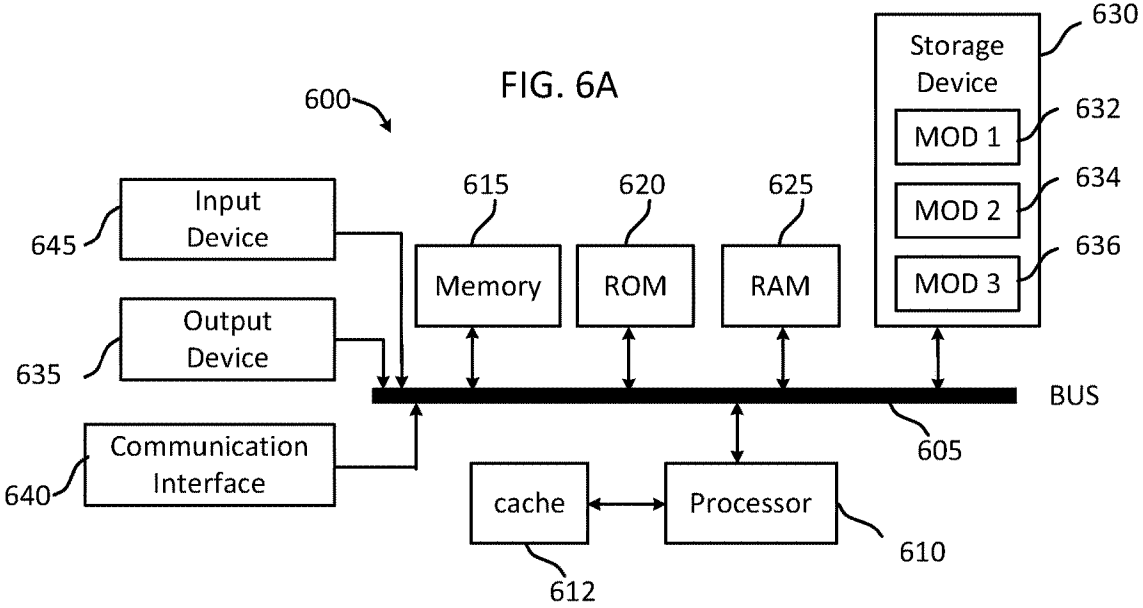
FIG. 6A and FIG. 6B illustrate exemplary possible system embodiment
Figure 6B:
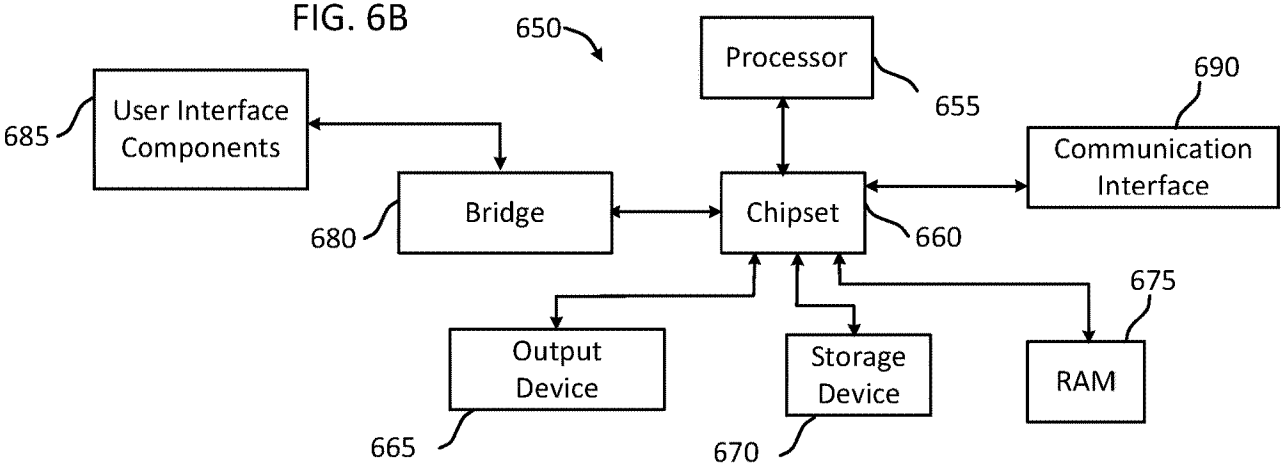

FIG. 6A, and FIG. 6B illustrate exemplary possible system embodiments. The more appropriate embodiment will be apparent to those of ordinary skill in the art when practicing the present technology. Persons of ordinary skill in the art will also readily appreciate that other system embodiments are possible.

FIG. 6A illustrates a conventional system bus computing system architecture 600 wherein the components of the system are in electrical communication with each other using a bus 605. Exemplary system 600 includes a processing unit (CPU or processor) 610 and a system bus 605 that couples various system components including the system memory 615, such as read only memory (ROM) 620 and random access memory (RAM) 625, to the processor 610. The system 600 can include a cache of high-speed memory connected directly with, in close proximity to, or integrated as part of the processor 610. The system 600 can copy data from the memory 615 and/or the storage device 630 to the cache 612 for quick access by the processor 610. In this way, the cache can provide a performance boost that avoids processor 610 delays while waiting for data. These and other modules can control or be configured to control the processor 610 to perform various actions. Other system memory 615 may be available for use as well. The memory 615 can include multiple different types of memory with different performance characteristics. The processor 610 can include any general purpose processor and a hardware module or software module, such as module 1 632, module 2 634, and module 3 636 stored in storage device 630, configured to control the processor 610 as well as a special-purpose processor where software instructions are incorporated into the actual processor design. The processor 610 may essentially be a completely self-contained computing system, containing multiple cores or processors, a bus, memory controller, cache, etc. A multi-core processor may be symmetric or asymmetric.

To enable user interaction with the computing device 600, an input device 645 can represent any number of input mechanisms, such as a microphone for speech, a touch-sensitive screen for gesture or graphical input, keyboard, mouse, motion input, speech and so forth. An output device 635 can also be one or more of a number of output mechanisms known to those of skill in the art. In some instances, multimodal systems can enable a user to provide multiple types of input to communicate with the computing device 600. The communications interface 640 can generally govern and manage the user input and system output. There is no restriction on operating on any particular hardware arrangement and therefore the basic features here may easily be substituted for improved hardware or firmware arrangements as they are developed.

Storage device 630 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 625, read only memory (ROM) 620, and hybrids thereof.

The storage device 630 can include software modules 632, 634, 636 for controlling the processor 610. Other hardware or software modules are contemplated. The storage device 630 can be connected to the system bus 605. In one aspect, a hardware module that performs a particular function can include the software component stored in a computer-readable medium in connection with the necessary hardware components, such as the processor 610, bus 605, display 635, and so forth, to carry out the function.

FIG. 6B illustrates a computer system 650 having a chipset architecture that can be used in executing the described method and generating and displaying a graphical user interface (GUI). Computer system 650 is an example of computer hardware, software, and firmware that can be used to implement the disclosed technology. System 650 can include a processor 655, representative of any number of physically and/or logically distinct resources capable of executing software, firmware, and hardware configured to perform identified computations. Processor 655 can communicate with a chipset 660 that can control input to and output from processor 655. In this example, chipset 660 outputs information to output 665, such as a display, and can read and write information to storage device 670, which can include magnetic media, and solid state media, for example. Chipset 660 can also read data from and write data to RAM 675. A bridge 680 for interfacing with a variety of user interface components 685 can be provided for interfacing with chipset 660. Such user interface components 685 can include a keyboard, a microphone, touch detection and processing circuitry, a pointing device, such as a mouse, and so on. In general, inputs to system 650 can come from any of a variety of sources, machine generated and/or human generated.

Chipset 660 can also interface with one or more communication interfaces 690 that can have different physical interfaces. Such communication interfaces can include interfaces for wired and wireless local area networks, for broadband wireless networks, as well as personal area networks. Some applications of the methods for generating, displaying, and using the GUI disclosed herein can include receiving ordered datasets over the physical interface or be generated by the machine itself by processor 655 analyzing data stored in storage 670 or 675. Further, the machine can receive inputs from a user via user interface components 685 and execute appropriate functions, such as browsing functions by interpreting these inputs using processor 655.

It can be appreciated that exemplary systems 600 and 650 can have more than one processor 610 or be part of a group or cluster of computing devices networked together to provide greater processing capability.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can comprise, for example, instructions and data which cause or otherwise configure a general purpose computer, special purpose computer, or special purpose processing device to perform a certain function or group of functions. Portions of computer resources used can be accessible over a network. The computer executable instructions may be, for example, binaries, intermediate format instructions such as assembly language, firmware, or source code. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can comprise hardware, firmware and/or software, and can take any of a variety of form factors. Typical examples of such form factors include laptops, smart phones, small form factor personal computers, personal digital assistants, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are means for providing the functions described in these disclosures.

Although a variety of examples and other information was used to explain aspects within the scope of the appended claims, no limitation of the claims should be implied based on particular features or arrangements in such examples, as one of ordinary skill would be able to use these examples to derive a wide variety of implementations. Further and although some subject matter may have been described in language specific to examples of structural features and/or method steps, it is to be understood that the subject matter defined in the appended claims is not necessarily limited to these described features or acts. For example, such functionality can be distributed differently or performed in components other than those identified herein. Rather, the described features and steps are disclosed as examples of components of systems and methods within the scope of the appended claims.

The invention claimed is:

1. A method comprising:

identifying, by a processor, from a group of image-tiles forming an image-tile map that represent a first image, a first set of active image-tiles that are within a boundary of a first view, wherein the boundary of the first view defines a first portion of the first image;

identifying, by the processor, from a group of render-tiles forming a render-tile map that are designated to render the group of image-tiles that represent the first image, a first set of active render-tiles that are within the boundary of the first view and are designated to render the first set of active image-tiles and to form a movable rendering context for the first set of active image-tiles, wherein the image-tile map and the render-tile map are different for respective image-tiles and render-tiles and each render-tile is sized to overlap multiple image-tiles and wherein multiple active image-tiles overlapped by an active render-tile are drawn as a single image onto the corresponding active render-tile; and drawing, by the processor, the first set of active image-tiles onto the first set of active render-tiles to display the first portion of the first image.

2. The method of claim 1, further comprising:

receiving data defining a second view, different than the first view, wherein a boundary of the second view defines a second portion of the first image;

identifying, from the group of image-tiles, a second set of active image-tiles that are within the boundary of the second view;

identifying, from the group of render-tiles, a second set of active render-tiles that are within the boundary of the second view and designated to render the second set of active image-tiles; and drawing, onto the second set of active render-tiles, a subset of the second set of active image-tiles that are not included in the first set of active image-tiles, resulting in the second set of active render-tiles displaying the second portion of the first image.

3. The method of claim 2, further comprising:

determining that the second set of active render-tiles does not include a first render-tile that is included in the first set of active render tiles;

storing the first render-tile in available memory.

4. The method of claim 3, further comprising:

determining that the second set of active render-tiles includes a second render-tile that was not included in the first set of active render-tiles; and reassigning the first render-tile that is available in memory to be the second render-tile.

5. The method of claim 3, further comprising:

receiving data defining a third view, different than the second view, wherein a boundary of the third view defines a third portion of the first image;

identifying, from the group of image-tiles, a third set of active image-tiles that are within the boundary of the third view;

identifying, from the group of render-tiles, a third set of active render-tiles that are within the boundary of the third view and designated to render the third set of active image-tiles, wherein the third set of active render-tiles includes the first render-tile; and accessing the first render-tile from memory.

6. The method of claim 2, further comprising:

determining that the second set of active render-tiles includes a second render-tile that was not included in the first set of active render-tiles;

determining that there are no render-tiles available in memory that are not included in the second set of active-render tiles; and generating the second render-tile.

7. The method of claim 1, further comprising:

presenting the first set of active render-tiles on a display of a client device, thereby presenting the first portion of the image.

8. A system comprising:

at least one processor; and a memory containing instructions that, when executed, cause the at least one processor to:

identify, from a group of image-tiles forming an image-tile map that represent a first image, a first set of active image-tiles that are within a boundary of a first view, wherein the boundary of the first view defines a first portion of the first image;

identify, from a group render-tiles forming an render-tile map that are designated to render the group of image-tiles that represent the first image, a first set of active render-tiles that are within the boundary of the first view and are designated to render the first set of active image-tiles and to form a movable rendering context for the first set of active image-tiles, wherein the image-tile map and render-tile map are different for respective image-tiles and render-tiles and each render-tile is sized to overlap multiple image-tiles and multiple active image-tiles overlapped by an active render-tile are drawn as a single image onto the corresponding active render-tile; and draw the first set of active image-tiles onto the first set of active render-tiles to display the first portion of the first image.

9. The system of claim 8, wherein the instructions further cause the at least one processor to:

receive data defining a second view, different than the first view, wherein a boundary of the second view defines a second portion of the first image;

identify, from the group of image-tiles, a second set of active image-tiles that are within the boundary of the second view;

identify, from the group of render-tiles, a second set of active render-tiles that are within the boundary of the second view designated to render the second set of active image-tiles; and draw, onto the second set of active render-tiles, a subset of the second set of active image-tiles that are not included in the first set of active image-tiles, resulting in the second set of active render-tiles displaying the second portion of the first image.

10. The system of claim 9, wherein the instructions further cause the at least one processor to:

determine that the second set of active render-tiles does not include a first render-tile that is included in the first set of active render tiles;

store the first render-tile in available memory.

11. The system of claim 10, wherein the instructions further cause the at least one processor to:

determine that the second set of active render-tiles includes a second render-tile that was not included in the first set of active render-tiles; and reassign the first render-tile that is available in memory to be the second render-tile.

12. The system of claim 10, wherein the instructions further cause the at least one processor to:

receive data defining a third view, different than the second view, wherein a boundary of the third view defines a third portion of the first image;

identify, from the group of image-tiles, a third set of active image-tiles that are within the boundary of the third view;

identify, from the group of render-tiles, a third set of active render-tiles that are within the boundary of the third view and designated to render the third set of active image-tiles, wherein the third set of active render-tiles includes the first render-tile; and access the first render-tile from memory.

13. The system of claim 9, wherein the instructions further cause the at least one processor to:

determine that the second set of active render-tiles includes a second render-tile that was not included in the first set of active render-tiles;

determine that there are no render-tiles available in memory that are not included in the second set of active-render tiles; and generate the second render-tile.

14. The system of claim 8, wherein the instructions further cause the at least one processor to:

present the first set of active render-tiles on a display of a client device, thereby presenting the first portion of the image.

15. A non-transitory computer-readable medium containing instructions that, when executed by a computing device, cause the computing device to:

identify, from a group of image-tiles forming an image-tile map that represent a first image, a first set of active image-tiles that are within a boundary of a first view, wherein the boundary of the first view defines a first portion of the first image;

identify, from a group render-tiles forming a render-tile map that are designated to render the group of image-tiles that represent the first image, a first set of active render-tiles that are within the boundary of the first view and are designated to render the first set of active image-tiles and to form a moveable rendering context for the first set of active image-tiles, wherein the image-tile map and render-tile map are different for respective image-tiles and render-tiles and each render-tile is sized to overlap multiple image-tiles and wherein multiple active image-tiles overlapped by an active render-tile are drawn as a single image onto the corresponding active render-tile; and draw the first set of active image-tiles onto the first set of active render-tiles to display the first portion of the first image.

16. The non-transitory computer-readable medium of claim 15, wherein the instructions further cause the computing device to:

receive data defining a second view, different than the first view, wherein a boundary of the second view defines a second portion of the first image;

identify, from the group of image-tiles, a second set of active image-tiles that are within the boundary of the second view;

identify, from the group of render-tiles, a second set of active render-tiles that are within the boundary of the second view and designated to render the second set of active image-tiles; and draw, onto the second set of active render-tiles, a subset of the second set of active image-tiles that are not included in the first set of active image-tiles, resulting in the second set of active render-tiles displaying the second portion of the first image.

17. The non-transitory computer-readable medium of claim 16, wherein the instructions further cause the computing device to:

determine that the second set of active render-tiles does not include a first render-tile that is included in the first set of active render tiles;

store the first render-tile in available memory.

18. The non-transitory computer-readable medium of claim 17, wherein the instructions further cause the computing device to:

determine that the second set of active render-tiles includes a second render-tile that was not included in the first set of active render-tiles; and reassign the first render-tile that is available in memory to be the second render-tile.

19. The non-transitory computer-readable medium of claim 17, wherein the instructions further cause the computing device to:

receive data defining a third view, different than the second view, wherein a boundary of the camera view defines a third portion of the first image;

identify, from the group of image-tiles, a third set of active image-tiles that are within the boundary of the third view;

identify, from the group of render-tiles, a third set of active render-tiles that are within the boundary of the third view designated to render the third set of active image-tiles, wherein the third set of active render-tiles includes the first render-tile; and access the first render-tile from memory.

20. The non-transitory computer-readable medium of claim 16, wherein the instructions further cause the computing device to:

determine that the second set of active render-tiles includes a second render-tile that was not included in the first set of active render-tiles;

determine that there are no render-tiles available in memory that are not included in the second set of active-render tiles; and generate the second render-tile.

21. The non-transitory computer-readable medium of claim 15, wherein the instructions further cause the computing device to:

present the first set of active render-tiles on a display of a client device, thereby presenting the first portion of the image.

* * * * *